US006592295B2

(12) United States Patent
McPhillips

(10) Patent No.: US 6,592,295 B2
(45) Date of Patent: Jul. 15, 2003

(54) EROSION CONTROL BLANKET INSTALLER

(76) Inventor: Kevin McPhillips, 800 Railroad Ave., Winters, CA (US) 95694

( * ) Notice: Subject to any disclaimer, the term of this patent is extended or adjusted under 35 U.S.C. 154(b) by 85 days.

(21) Appl. No.: 09/976,133

(22) Filed: Oct. 12, 2001

(65) Prior Publication Data

US 2003/0072622 A1 Apr. 17, 2003

(51) Int. Cl.[7] ..... A01B 29/04

(52) U.S. Cl. ..... 405/129.9; 405/302.7; 405/15

(58) Field of Search ..... 405/302.7, 302.4, 405/302.6, 303, 15, 258.1, 129.1; 172/21, 22; 111/199; 47/56

(56) References Cited

U.S. PATENT DOCUMENTS 2,845,884 A * 8/1958 Clausing et al. ..... 172/21
4,909,667 A * 3/1990 DeMello ..... 405/129.9
5,525,012 A * 6/1996 Casimaty et al. ..... 405/302.7
6,171,022 B1 * 1/2001 Decker ..... 405/15

* cited by examiner

*Primary Examiner*—Heather Shackelford
*Assistant Examiner*—John Kreck
(74) *Attorney, Agent, or Firm*—Fliesler Dubb Meyer & Lovejoy

(57) ABSTRACT

A device for installing erosion control blankets is provided. The device comprises a frame, a circular drum, an erosion control blanket mounting device, and a weight support device. The circular drum comprises a plurality of spring loaded pins that are used to punch the erosion control blankets into the ground simultaneously as the device rolls out the erosion control blankets. The spring loaded pins are in the retracted position until the pass over a cam, after which the spring loaded pins extend outwardly to punch the erosion control blankets into the ground. After the spring loaded pins pass over the cam the spring loaded pins return to the retracted position. Weights may be added or removed from the weight support device to obtain the desired erosion control blanket to soil compression.

8 Claims, 1 Drawing Sheet

EROSION CONTROL BLANKET INSTALLER

TECHNICAL FIELD

This present invention relates to an apparatus and method for controlling soil erosion and, in particular, an apparatus and method for installing erosion control blankets.

BACKGROUND

The banks of dunes, cliffs, sloping grounds, and other properties are subject to highly undesirable erosion. Due to the cycling of temperature, moisture, freezing and other conditions, the surface layers thereof typically are unstable and tend to creep downwardly in shear. Sooner or later their facings give rise to serious dislocations unless steps are taken to secure the unstable surface layers against erosion.

In order to prevent erosion and for both aesthetic and environmental protection reasons, it is often necessary or desirable to grow ground vegetation because the roots of vegetation planted along such properties tend to secure the unstable surface layers against erosion. The successful sprouting and growth of ground vegetation planted on these areas, however, is often prevented by the soil erosion which the planted vegetation is designed to inhibit, the erosion frequently carrying away at least some portion of the soil before the vegetation takes hold. Furthermore, adverse weather may inhibit the vegetation growing process. For example, in a storm the banks of such properties are subjected to powerful winds and rain that often carry away the facing soil, and with it, any vegetation rooted therein.

To alleviate this problem of eroding vegetation roots, it is now a common practice to lay erosion control blankets over grass seedlings. The protective covering most used is what is best termed a blanket or mat comprised of netting and underlying excelsior. One particularly effective erosion control blanket is the "Curlex" or excelsior blanket manufactured and sold by the American Excelsior Company of Arlington, Tex. since 1964. This erosion control blanket is fabricated, in elongated rectangular mat form, from elongated, randomly intertwined fiber commonly referred to as "excelsior" or "wood wool." The fiber mats have historically been held together or contained by photodegradable netting material, which form nets on one or both sides of the fiber. The erosion control blanket assemblies are then conveniently packaged in individually rolled bundles to facilitate their handling and transport to the erosion control job site.

At the job site, the erosion control blanket bundles are unrolled in a side-to-side relationship along the earth area to be protected against erosion, and are secured along the sides of one another and to the underlying ground area with the use of a spaced series of conventional ground staple members, which may be made of steel, wood, plastic or starch. The installed erosion control blankets generally have parallel sides and abut one another to form a substantially solid surface to shield the underlying earth area, and thus the planted ground vegetation therein, from wind and rain erosion forces. The erosion control blanket must be fastened in place in the ground so that it will not be displaced from the desired location by weather effects such as rain, water runoff or wind.

To secure the erosion cloth, the usual practice has been to use a hammer which drives stakes or staples through the erosion control blanket into the ground at suitably spaced intervals to retain the erosion control blanket in place against weather effects such as wind, water and rain. However, not more than about 200 staples per hour can be inserted by a person using such methods and the user must be on his hands and knees or bent over to operate the hammer. Clearly, using a hammer to drive in stakes and staples is a slow and inefficient process and, furthermore, the large amount of physical work combined with the users' body positioning leads to a number of degenerative physical effects such as neck, back, knee, wrist and joint problems. Thus, devices for installing ground fasteners were created to more efficiently install the erosion control blanket fasteners and alleviate the amount of physical work a user must endure when installing these fasteners.

For example, U.S. Pat. No. 4,627,563 to Meyer discloses a device for driving U-shaped anchors downwardly so as to secure the blanket to the ground at selected locations. The device comprises a shoe having a sole plate that is adapted to engage the netting or other upper surface of whatever sheet-like material is to be anchored. The sole plate has a transverse slot through which a plunger is moved downwardly when a U-shaped anchor has been advanced into alignment beneath the plunger. The plunger is carried at the lower end of a reciprocal piston rod which has a piston at its upper end. By means of a foot-operable valve, compressed air is introduced into the upper end of the cylinder, thereby forcing the piston, the piston rod and the plunger downwardly so as to force an anchor into the ground.

In another example, U.S. Pat. No. 4,706,864 to Jacobsen et al. discloses a foot-operated machine for implanting fastener elements in the ground through an erosion cover on the ground. The machine has a hollow vertical column slidably receiving a vertically reciprocal driver connected to a foot pedal on the outside of the column. A post extends up from the column and carries a top cross piece with hand grips which a person may grasp while standing substantially erect with one foot on the foot pedal. A magazine assembly feeds fastener elements individually in succession into the column to be forced down into the ground when the driver is moved down by pushing the foot pedal down.

In still another example, U.S. Pat. No. 4,826,066 to Koester et al. discloses a staple insertion apparatus for sequentially inserting a plurality of staples through a selected material into the ground. A housing having a top, bottom, and sides, with first and second open ends, forms a chamber there between. The chamber is sized to receive a plurality of staples selected from four to 12 inches in length. The staples are inserted into the chamber from the second open end. A staple advancing member biases the staples towards the first open end. A vertically disposed tubular member is secured to the housing above the first open end of the chamber. An elongated drive member is slidably disposed at least partially within the tubular member. A staple retaining member positions the forwardmost staple beneath the elongated drive member. A foot actuation member is secured to the drive member. The drive member forcibly biases the forwardmost staple through the selected material, into the ground, when the operator exerts a downward force from a standing position upon the foot actuation member. As the operator's foot is raised, a biasing member disposed within the tubular member raises the drive member. The staple advancing member positions the next staple beneath the drive member for subsequent insertion of the next staple through the material, into the ground.

In yet another example, U.S. Pat. No. 5,025,969 Koester et al. discloses a dual actuation staple insertion apparatus for sequentially inserting a plurality of staples through a selected material into the ground when actuated by a downward force from an operator upon opposing handles, foot actuation member or both. The apparatus comprises a housing with a bottom, sides and a top forming a chamber there between, with open end portions. A tubular member is secured to the housing, and a drive means is slidably received in the tubular member. A biasing member is disposed upon the drive means above the tubing, and acts against a stop to raise the drive means to an upper operating position. A staple advancing means urges the plurality of staples into position beneath the drive means in preparation for the next staple insertion.

In order to install erosion control blankets, a user must roll the blankets over the ground. This type of installation requires the user to exert physical force in a bent over position which leads to back, neck and knee problems. After the erosion control blankets are installed, the blankets must then be fastened to the ground. Devices for fastening erosion control blankets to the ground are well known in the industry. However, these devices, including the each of the devices cited in the above references, still require manual labor when fastening the erosion control blankets into the ground. Here, the user must carry the device to the desired locations and then use the device to implant the fasteners through the erosion control blanket and into the ground. This type of manual labor also requires the user to exert a vast amount of physical work which leads to degenerative effects on the user's body. Furthermore, manually rolling out and securing the erosion control blankets onto the ground and fastening these blankets to the ground with devices that require manual operation is slow and inefficient.

Therefore, what is needed is a device that enables a user to efficiently install and secure erosion control blanks while using minimal manual labor.

SUMMARY

An object of my invention is to provide a device that enables a user to efficiently install erosion control blankets while using minimal manual labor.

Another object of my invention is to provide a device that enables a user to efficiently secure erosion control blankets to the ground while using minimal manual labor.

A further object of my invention is it provide a device that enables a user to both efficiently install and secure erosion control blankets while using minimal manual labor.

Yet another object of my invention is to provide a user with a method for efficiently installing erosion control blankets while using minimal manual labor.

Still another object of my invention is to provide a user with a method for efficiently securing erosion control blankets to the ground while using minimal manual labor.

Still another object of my invention is to provide a user with a method for efficiently installing and securing erosion control blankets while using minimal manual labor.

The present invention meets the above-mentioned objects by providing a device, wherein the device may be used with a machine such as an excavator type of machine with an extended boom, that both installs erosion control blankets and punches the erosion control blankets into the ground. By using the device for installing and punching the erosion control blankets into the ground, both the need for manually rolling out the erosion control blankets and the need for installing stakes for fastening the erosion control blankets to the ground is completely eliminated. Thus, the present invention dramatically reduces manual labor and completely eliminates the need for stakes.

The device comprises a drum, an erosion control blanket mounting device, and a weight support device, all of which are mounted on a frame. The drum comprises a cam and a plurality of spring loaded pins. These spring loaded pins are naturally in the retracted position. When the device is set in motion, these pins pass over the cam and extend outwardly to punch the erosion control blankets into the ground, thus eliminating the need for stakes and stake labor. When the pins pass by the cam, the pins return to their natural retracted position. The device also enhances the erosion control blanket to soil contact by providing a weight support device. In this weight support device, weight can be added for the enhancement of erosion control blanket to soil contact on harder soil, or weight can be removed for the reduction of erosion control blanket to soil contact on softer soil. The present invention may also include a bin for seed and/or fertilizer dispersion such that the bin may disperse seed and/or fertilizer prior to installation of the erosion control blankets.

DETAILED DESCRIPTION OF THE PREFERRED EMBODIMENTS

Figures 1, 2:
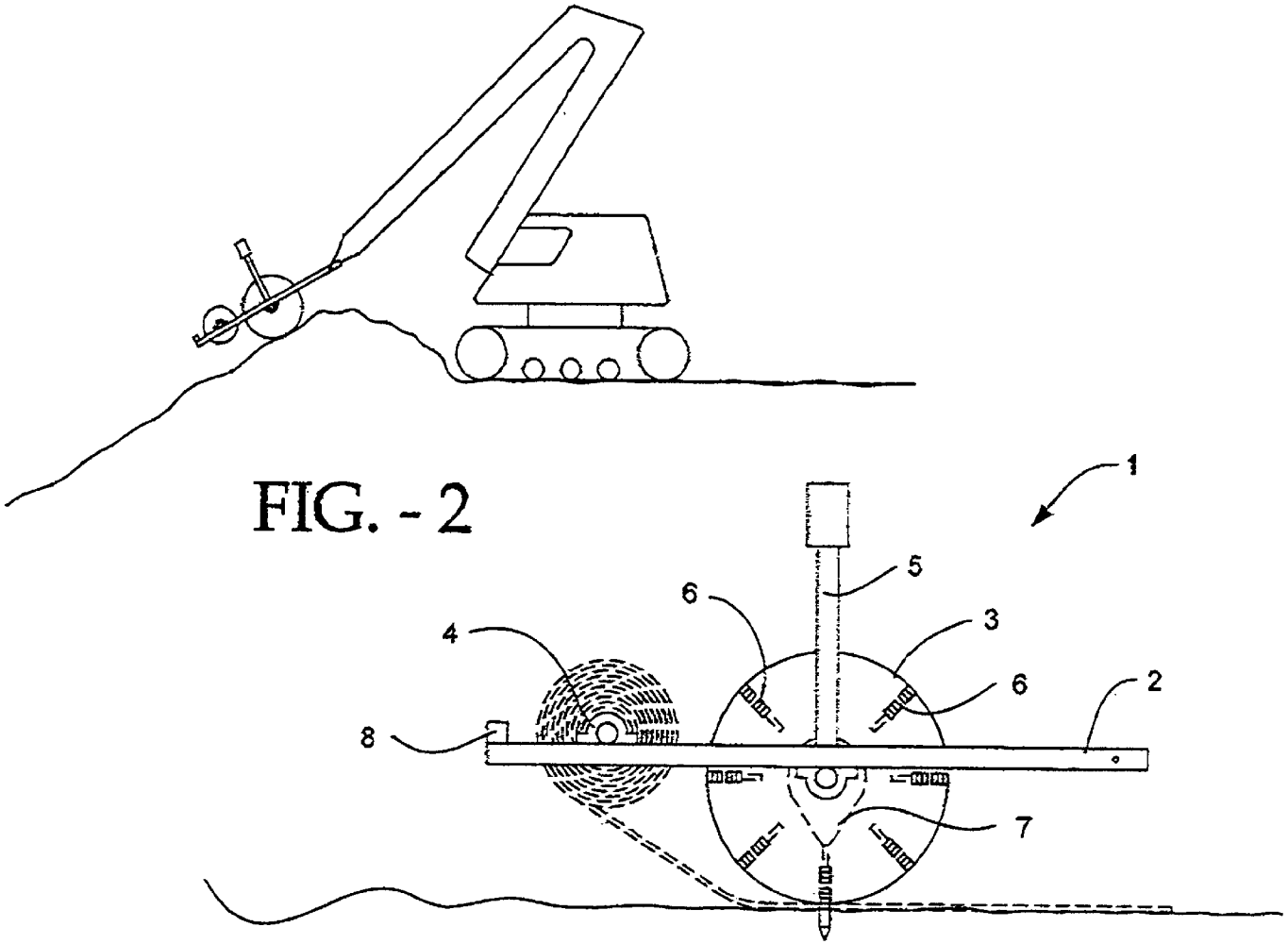
FIG. 1 is a perspective view of the device for installing erosion control blankets in a preferred embodiment of the applicant's invention.
FIG. 2 is a perspective view depicting the erosion control blanket being used with an excavator type machine having an extended boom.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring to FIG. 1, therein is depicted a preferred embodiment of the device for installing erosion control blankets 1. The device for installing erosion control blankets 1 comprises a frame 2, a circular drum 3, a erosion control blanket mounting device 4, and a weight support device 5. The weight support device 5 is mounted such that weight may be added or removed above the circular drum 3 to ensure sufficient compression and contact between the erosion control blanket and the soil. Sufficient compression and contact between the erosion control blanket and the soil prevents adverse weather such as wind and rain from eroding the soil there between. The erosion control blanket mounting device 4 is located on the frame 2 such that as the device for installing erosion control blankets 1 is rolled in a direction of travel, the blankets unroll as they are being compressed to the soil by the circular drum 3.

In a preferred embodiment, the circular drum 3 comprises a cam 7 and a plurality of spring loaded pins 6 located inside of the circular drum 3. These spring loaded pins 6 are in the retracted position such that they are, at minimum retraction, flush with the surface of the circular drum 3. The spring loaded pins 6 remain in the retracted position unit the spring loaded pins pass by the cam 7, also located in the circular drum 3. As the spring loaded pins 6 pass by the cam 7, the spring loaded pins 6 extend outwardly to punch the erosion control blanket into the soil. After the spring loaded pins 6 pass by the cam 7, the spring loaded pins 6 return the their naturally retracted position.

In a preferred embodiment, the cam 7 is located about the center of the circular drum 3 such that this location of the cam 7 forces the spring loaded pins 6 to maximally extend while the circular drum 3 is centered over the erosion control blanket. The cam 7 may be substantially shaped conically with a rounded bottom such that the spring loaded pins 6 are gradually extended and gradually retracted while the device for installing erosion control blankets 1 is rolled in a direction of travel. Such gradual retraction and gradual extension of the spring loaded pins 6 prevents the erosion control blanket from being torn or ripped as the spring loaded pins 6 punch them into the soil. Furthermore, this gradual retraction and gradual extension of the spring loaded pins 6 also prevents the springs from instantaneous extension, thereby preventing the springs from distortion and rendering the spring loaded pins 6 inoperable.

In a preferred embodiment, the device for installing erosion control blankets 1 eliminates the need for stakes because the device punches the erosion control blankets into the ground, as compared to traditional devices used for securing erosion control blankets to the ground comprised of stakes and hammers such that the hammers are used to drive the stakes through the erosion control blankets and into the ground. In this preferred embodiment, the device for installing erosion control blankets 1 simultaneously installs and punches the erosion control blankets into the ground when a machine, such as a machine with an extended type boom shown in FIG. 2, rolls the device in desired direction of travel. Thus, the device for installing erosion control blankets 1 is cost efficient by eliminating the need for stakes, saving time, saving money and saving manual labor.

In a preferred embodiment, the device for installing erosion control blankets 1 comprises a frame 2 wherein the frame 2 is made of hard metal such as steel. The frame 2 is not limited to a particular shape, however, the frame 2 may be tubular, rectangular, or square. The frame 2 may also include members for structural stability such as cross members. The frame 2 comprises an erosion control blanket mounting device 4 located at a first end of the frame 2, an attaching mechanism located at a second end of the frame 2 to allow the frame to be attached to a machine such as an excavator type machine with an extended boom, and a circular drum 3 located there between.

In a preferred embodiment, the device for installing erosion control blankets includes a bin to hold and disperse seeds and/or fertilizer prior to installation of the erosion control blankets.

Traditional methods for installing erosion control blankets require the user to roll out the erosion control blankets and secure them into the ground using a hammer and stakes, however, this traditional method is slow and physically demanding. In a preferred method for installing erosion control blankets, as a machine rolls the device for installing erosion control blankets 1, the erosion control blankets unroll from the erosion control blanket mounting device 4 simultaneously as the circular drum 3 both compresses the erosion control blanket to the soil and punches the erosion control blankets into the soil using spring loaded pins 6. Thus, the preferred method eliminates the manual labor of rolling out the erosion control blankets and staking them into the ground. Furthermore, the preferred method eliminates the need for stakes because instead of using stakes as in traditional methods of installing erosion control blankets, the preferred method employs spring loaded pins 6 located in the circular drum 3 to punch the erosion control blanket into the soil thereby securing the erosion control blankets in place. Therefore, the preferred method for installing erosion control blankets is cost efficient by eliminating the need for stakes, saving time, saving money and saving manual labor.

If proper contact between the erosion control blankets and the soil is not obtained, adverse weather such as powerful winds and rain may intervene between the blankets and the soil, thus carrying away the facing soil, and with it, any vegetation rooted therein. In a preferred method for installing erosion control blankets, weight may be added to or removed from the weight support device 5 to ensure proper compression and contact of the erosion control blanket to the soil, thereby preventing adverse weather from eroding the soil.

It is beneficial to seed and/or fertilize the soil prior to installation of the erosion control blankets. The preferred method provides for seed dispersion by using a bin 8 to hold and disperse seed and/or fertilizer prior to installation of the erosion control blankets.

It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

What is claimed is:

1. A device for installing erosion control blankets comprising:

a frame comprising an erosion control blanket mounting device, and a weight support device;

a drum mounted on said frame, said drum comprising a cam and a plurality of spring loaded pins, wherein said spring loaded pins remain in a retracted position until said spring loaded pins pass by said cam after which said spring loaded pins extend and then retract after passing by said cam; and a dispersion bin mounted on the frame.

2. A device for installing erosion control blankets comprising:

a frame;

a drum mounted on said frame, said drum comprising a cam and a plurality of spring loaded pins, wherein said spring loaded pins remain in a retracted position until said spring loaded pins pass by said cam after which said spring loaded pins extend and then retract after passing by said cam; and an erosion control blanket mounting device mounted on said frame.

3. The device for installing erosion control blankets of claim 2, wherein said erosion control blanket mounting device is mounted on said frame in front of said drum.

4. The device for installing erosion control blankets of claim 2, further comprising a weight support device mounted on said frame.

5. The device for installing erosion control blankets of claim 2 further comprising a bin whereby said bin holds and disperses seed and/or fertilizer.

6. A method for installing erosion control blankets onto soil, the method comprising the steps of:

placing an erosion control blanket on a frame;

unrolling the erosion control blanket while the frame is rolling in a desired direction of travel; and punching the erosion control blanket into the soil with pins as the pins pass by a cam while the frame is rolling in a desired direction of travel.

7. The method of claim 6, further including the step of at least one of adding or removing weight from a weight support device.

8. The method of claim 6, further including the step of dispersing seed and/or fertilizer prior to punching the erosion control blanket into the soil.

* * * * *